US006442824B2

(12) United States Patent
Stanley et al.

(10) Patent No.: US 6,442,824 B2
(45) Date of Patent: Sep. 3, 2002

(54) COMPROMISE RAIL

(75) Inventors: Tom Stanley, Vancouver; Paul Valastin, North Vancouver, both of (CA)

(73) Assignee: Vae Nortrak North America, Inc., Cheyenne, WY (US)

( * ) Notice: Subject to any disclaimer, the term of this patent is extended or adjusted under 35 U.S.C. 154(b) by 0 days.

(21) Appl. No.: 09/976,879

(22) Filed: Oct. 11, 2001

Related U.S. Application Data

(62) Division of application No. 09/569,368, filed on May 11, 2000, now Pat. No. 6,325,299.

(51) Int. Cl.[7] ..... B23P 13/04
(52) U.S. Cl. ..... 29/557; 29/16; 72/377
(58) Field of Search ..... 29/16, 557; 238/23, 238/122, 125, 126, 151, 162, 164, 167; 72/377; 105/178

(56) References Cited

U.S. PATENT DOCUMENTS

| | | | | | |
|---|---|---|---|---|---|
| 1,763,501 | A | * | 10/1930 | Braine | 238/167 |
| 3,658,245 | A | * | 4/1972 | Nelson | 238/151 |
| 3,837,948 | A | * | 9/1974 | Nelson et al. | 156/71 |
| 3,851,821 | A | * | 12/1974 | Lopez | 238/230 |
| 3,952,948 | A | * | 4/1976 | Nelson et al. | 238/243 |
| 4,105,160 | A | * | 8/1978 | Ramer | 238/167 |
| 4,360,154 | A | * | 11/1982 | Collins | 238/262 |
| 4,466,570 | A | * | 8/1984 | Howard | 238/226 |
| 4,485,967 | A | * | 12/1984 | Edwards | 238/226 |
| 4,773,590 | A | * | 9/1988 | Dash et al. | 238/153 |
| 4,922,743 | A | * | 5/1990 | Hillegass et al. | 72/377 |
| 5,230,469 | A | * | 7/1993 | Fisher | 238/210 |
| 5,249,654 | A | * | 10/1993 | Bruning | 191/22 DM |
| 5,251,732 | A | * | 10/1993 | Bruning | 191/22 DM |
| 5,267,634 | A | * | 12/1993 | Bruning | 191/22 DM |
| 5,423,267 | A | * | 6/1995 | Eklund | 104/264 |
| 5,503,331 | A | * | 4/1996 | Urmson, Jr. et al. | 238/152 |
| 5,533,670 | A | * | 7/1996 | Chen | 238/187 |
| 5,605,283 | A | * | 2/1997 | Lahnsteiner et al. | 238/164 |
| 5,842,637 | A | * | 12/1998 | Lanzer | 238/152 |
| 6,325,299 | B1 | * | 12/2001 | Stanley et al. | 238/167 |

FOREIGN PATENT DOCUMENTS

| | | | | |
|---|---|---|---|---|
| JP | 354136008 | * | 10/1979 | 238/122 |

* cited by examiner

*Primary Examiner*—S. Thomas Hughes
*Assistant Examiner*—Essama Omgba
(74) *Attorney, Agent, or Firm*—Michael A. Glenn; Christopher Peil

(57) ABSTRACT

A compromise rail is formed of a single length of stock rail. One end of the rail is forged over a distance of 19–48 inches to reduce the height of the forged portion, which is then machined to match the running rail to which that end is to be attached. The invention avoids the expense and inconvenience of flash butt welding a forged section to a uniform profile rail as is done in prior art compromise rails.

3 Claims, 4 Drawing Sheets

COMPROMISE RAIL

CROSS REFERENCE TO RELATED APPLICATION

This application is a division of U.S. patent application Ser. No. 09/569,368, filed on May 11, 2000, now U.S. Pat. No. 6,325,299.

TECHNICAL FIELD OF THE INVENTION

This invention relates to a compromise rail for effecting a transition between two rails having different profiles.

BACKGROUND OF THE INVENTION

Within a railway network of a given gauge, rails of different sectional profiles may be used. For example, such profiles may vary in the base to head height, the width of the web, the width of the head or the width of the base. One prior art approach to effecting a transition between two rails having different profiles is to provide a compromise joint bar which is attached to the two rail sections of differing profiles. The compromise joint bar is typically wedged into and secured to the fishing areas of the two rails to be joined. FIG. 1 illustrates such an approach. The compromise joint bar approach suffers the disadvantage of being a mechanical joint in track work, and as is the case with such joints, this results in discontinuities between the rail ends, broken bolts and high wear and maintenance costs.

With the advent of continuous welded rail, an alternative approach has been to provide a compromise rail which is inserted between the running rails having different profiles. As shown in FIG. 2, the compromise rail includes a first section 12 having a profile matching the profile of a running rail to which one end of the compromise rail is to be attached. A transition section 14 is formed at the end of the first section 12. The end of the transition section is flash butt welded at 16 to a section 18 having a uniform profile matching the running rail to which the other end of the compromise rail is to be attached. The transition section 14 therefore has a profile that varies between the profiles of the two running rails. This is done by forging, bending and machining one end of the compromise rail over a distance of approximately 10 or 11 inches. The forging creates the change in profile. The bending and machining ensures that the gauge lines will match up. Bending and machining are used so that the web of the forged section will also match up with the web of the uniform profile section.

The use of a uniform profile section 18 in the compromise rail of the prior art provides a length of rail which can be cut in the field so as to match the length of the compromise rail to the length of the gap between the two running rails and provides a reliable match to the profile of one of the running rails. It also allows the forged portion to be very short.

Typically, thermite welding is used to weld the compromise rail to each running rail. But thermite welding is time consuming. In order to avoid disruptions in rail traffic, installers sometimes provide a temporary joint between the compromise rail and the running rail and defer thermite welding until traffic conditions improve. The temporary joint is accomplished by providing holes in the web of the uniform profile section of the compromise rail and using a standard joint bar to temporarily secure the uniform profile section of the compromise rail to the running rail.

A disadvantage of the compromise rail of the prior art is that the flash butt welding which is typically used to attach to uniform profile section to the forged section is very expensive.

It is therefore an object of the present invention to provide means for establishing an effective transition between two rail profiles that avoids the expense of flash butt welding a uniform profile section to a forged section, yet still provides the advantages of a compromise rail which may be cut in the field to the match the gap between two running rails to be matched.

It is a further object of the invention to accommodate a temporary joint between the compromise rail and the running rails.

SUMMARY OF THE INVENTION

According to the invention, the uniform profile section of the compromise rail is essentially eliminated so as to avoid the need for a flash butt weld operation. In order to accommodate a temporary joint between the compromise rail and a running rail, the forging is extended such that it includes a segment matching the profile of one of the running rails and being at least 19 inches long. This is the approximate minimum length required for the use of a typical joint bar. The extended length of the forging also ensures that sufficient space will be available for eventual thermite welding to the running rail in the field.

Accordingly, this invention comprises a compromise rail for providing a transition between two running rails having different profiles said compromise rail being entirely forged and having a first section having a substantially uniform first profile along the length of said first section, a second section having a substantially uniform second profile along the length of said second section, and an intermediate section effecting a transition from said first profile to a second profile, said second section having a length of at least 19 inches.

Although forging a length of 19 inches is more difficult to achieve than the prior art forging which extends a distance of perhaps 10 inches, the cost saving in avoiding the use of uniform profile rail section that needs to be flash butt welded justifies the extra effort involved in producing a longer forging.

Other aspects and features of the invention will be appreciated by reference to the detailed description of the preferred embodiment which follows and to the claims.

DETAILED DESCRIPTION OF THE PREFERRED EMBODIMENT OF THE INVENTION

Figure 1:
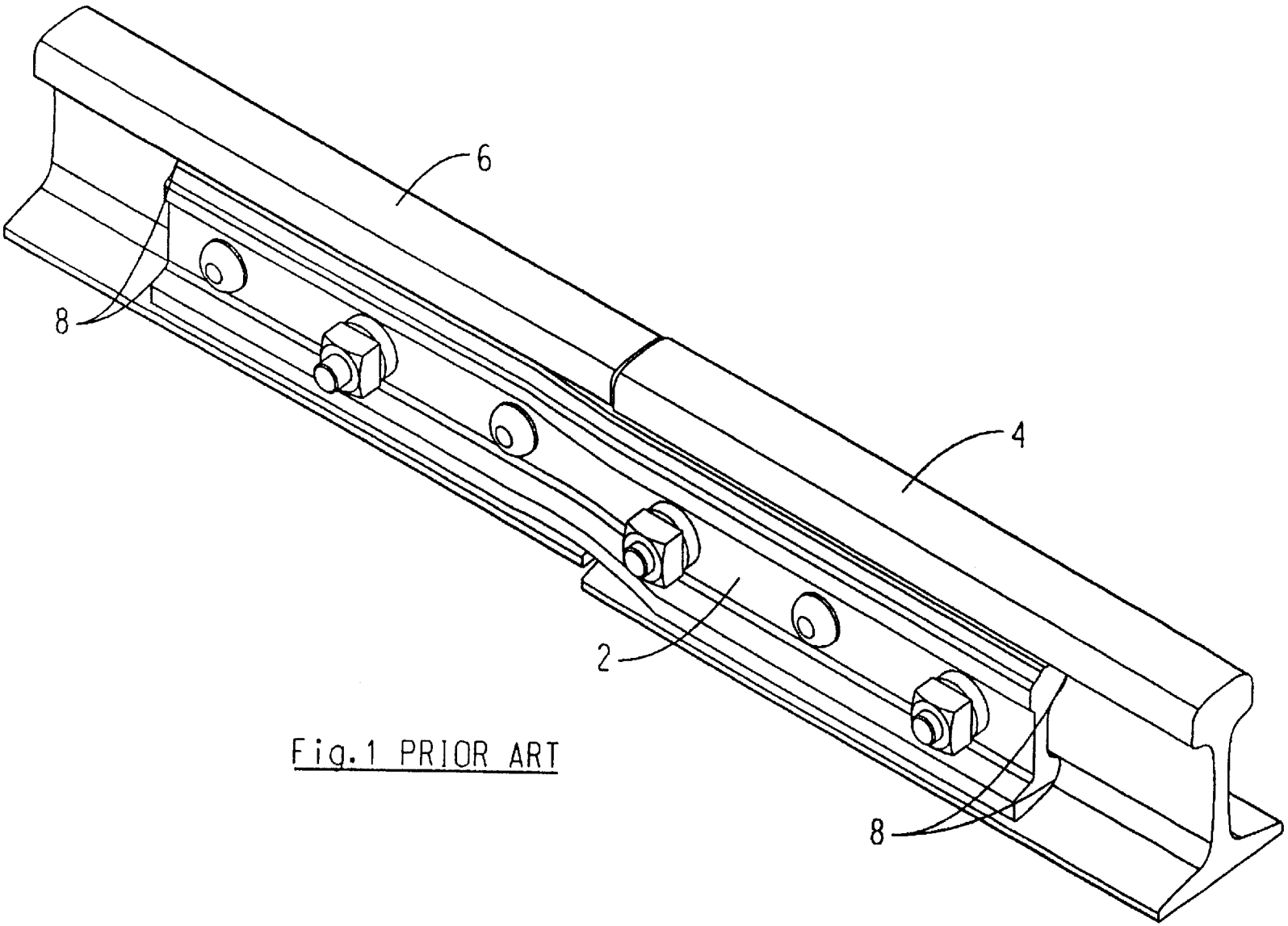
Fig.1 PRIOR ART
FIG. 1 is a perspective view of a compromise joint bar according to the prior art.

FIG. 1 illustrates a compromise joint bar according to the prior art. The compromise joint bar 2 extends between a running rail 4 having a first profile and a running rail 6 having a second profile. The compromise joint bar 2 is wedged and secured in the fishing areas 8 of the running rails to be joined.

Figure 2:
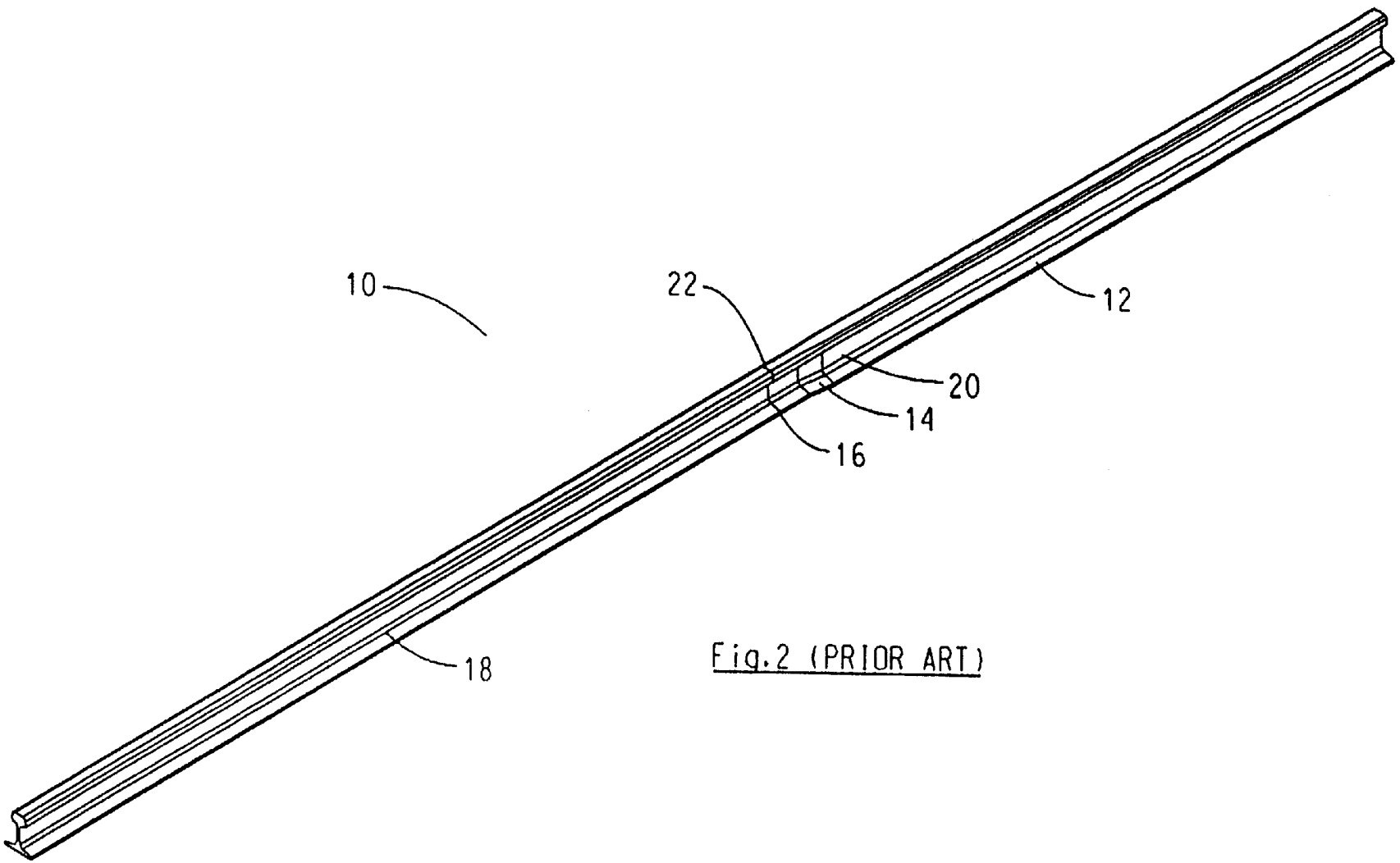
Fig.2 (PRIOR ART)
FIG. 2 is a perspective view of a compromise rail according to the prior art.

FIG. 2 illustrates a compromise rail 10 according to the prior art. It includes a first section 12, a transition section 14 and a uniform profile section 18. Uniform profile section 18 consists of standard rail having a profile matching the profile of a first running rail (not shown). Sections 14 and 18 are flash butt welded as at 16. Transition section 14 is formed by forging the end of first section 12 so as to have a first end 20 having a profile matching the profile of section 12 and a second end 22 matching the profile of the uniform profile section 18. Forged transition section 14 may also be machined and/or bent to further ensure matching of the positions of the webs and gauge side at flash butt weld 16.

Figure 3:
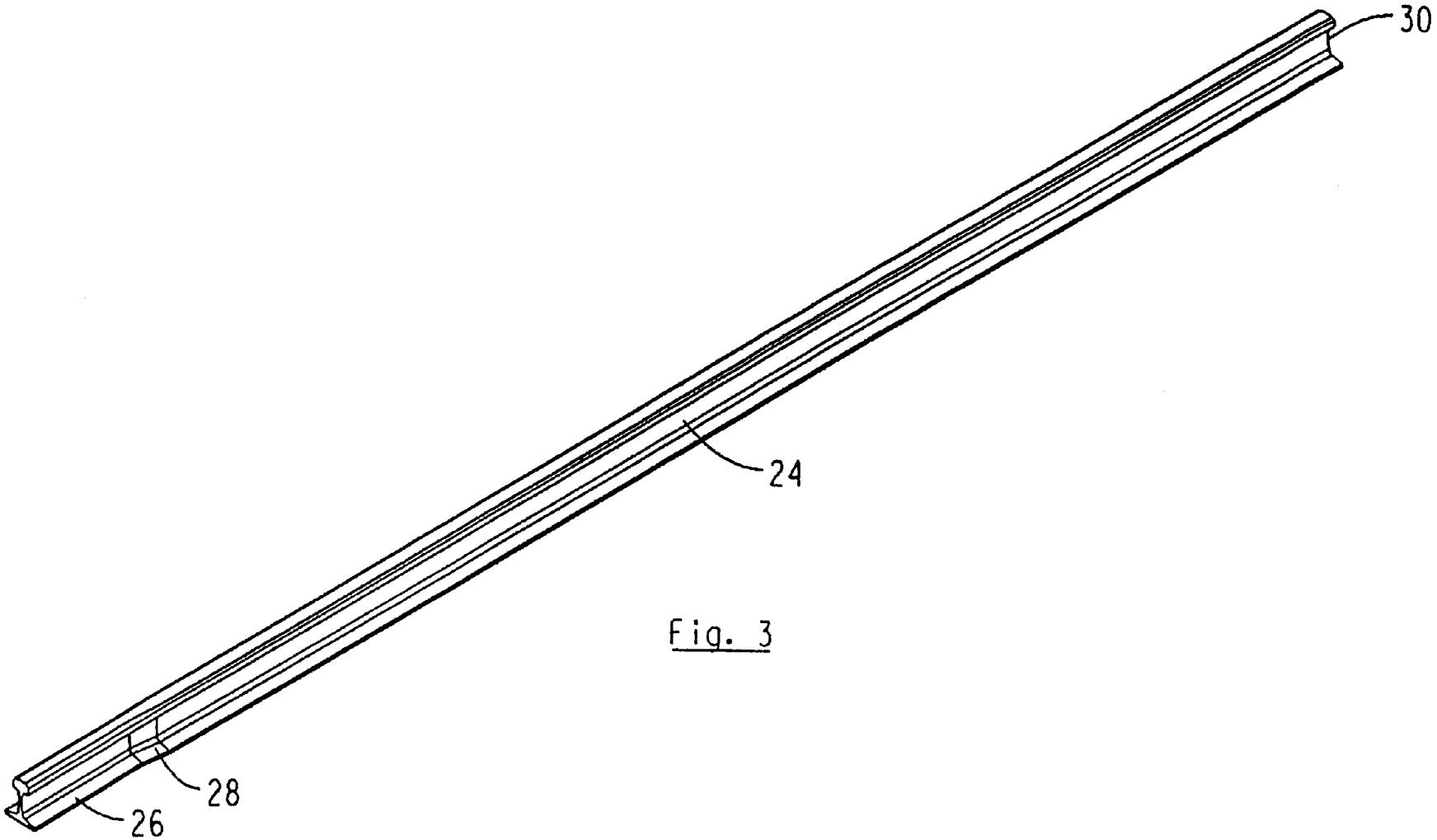
FIG. 3 is a perspective view of a compromise rail according to the invention.
Figure 4:
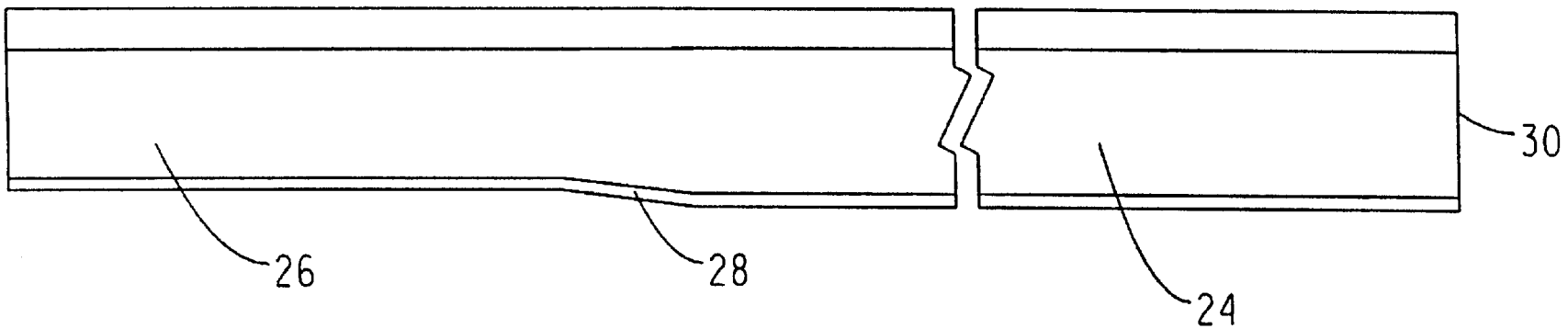
FIG. 4 is a plan view of a compromise rail according to the invention.

FIG. 3 is a perspective view of a compromise rail according to the invention. The entire compromise rail is formed from a single section of rail. A first section 24 consists of a length of substantially uniform profile. A second section 26 is of a substantially uniform profile different from the profile of first section 24. The length of second section 26 is preferably at least 19 inches, being the minimum length needed to accommodate a typical joint bar. However the length may be up to 48 inches. Intermediate section 28 effects a transition from the profile of first section 24 to the profile of second section 26. Sections 24 and 26 have gauge lines and head heights that match.

The forged transition section 28 according to the invention is manufactured in a manner similar to that used to manufacture the forged transition section 14 of compromise rails according to the prior art, except that the end of the forged portion is extended in length as at 26, and no additional rail section is flash butt welded to the forged portion. Accordingly, a length of rail having a uniform profile throughout its length is first cut to approximately the desired length of the compromise rail. One end of the rail is then forged in an open die to reduce the height of the rail in section 26 and to introduce a transition in height at intermediate section 28 between the unreduced height of the rail and the reduced height of section 26. Section 26 is thereby reduced in height to the height of the shorter of the running rails to be matched. The forging process is preferably performed such that it is preferentially the web of the rail which undergoes deformation rather than the head or the base.

Once the desired height is achieved for section 26 and a transition is effected through intermediate section 28, those sections will typically be machined to remove any bulge material caused by the reduction in height. Section 26 will usually also be further machined to generate the desired rail profile to match the profile of the running rail to which it will be attached.

If the widths of the heads for section 26 and section 24 are not equal (i.e. if the machining of section 26 involved a change in the width of the head), intermediate section 28 will also be bent to align the gauge lines of sections 24 and 26. Bending is preferable to machining as it will also align the web of section 26 to match the web of the running rail to which section 26 is to be attached.

In the field, the compromise rail according to the invention would first be cut a certain distance inward from end 30 so as to provide an overall length for the compromise rail which matches the gap between the two running rails at either end of the compromise rail. It will be appreciated that any reduction in length of the compromise rail should be achieved by cutting inward from end 30 rather than cutting the forged section 26.

Once the compromise rail has been inserted between the two running rails, thermite welding may be used at each end to produce continuous welded rail track work. In cases where the time or equipment required to establish a thermite weld is insufficient, holes may be provided in the web portion of section 26 so as to accommodate a temporary joint bar to be bolted to both section 26 and the adjacent running rail.

The compromise rail according to the invention therefore completely avoids the need to flash butt weld two components to produce the compromise rail. Providing a forged transition section which extends to a length of running rail profile provides an appropriate rail section for welding to the running rail. The length of the extended forged section is at least the minimum length needed to accommodate the use of standard joint bars for temporary installation of the compromise rail.

It will be appreciated certain variations may be practiced on the preferred embodiment without departing from the scope of the invention.

What is claimed is:

1. A method of manufacturing a compromise rail for providing a transition between two running rails having different profiles, from a single length of rail stock, comprising the steps of:

providing a single length of rail stock having a first end and a second end, a substantially uniform original profile and a substantially uniform original base to head height along its length;

forging a portion of said rail stock extending inward at least 19 inches from said first end so as to uniformly reduce the base to head height of said portion and to create a transition between said portion and the balance of said length of rail stock such that one end of said transition has said original base to head height and the other end of said transition has said reduced base to head height.

2. A method according to claim 1 further comprising the steps of:

machining said portion to remove bulge material and to modify the profile of said portion.

3. A method as in claim 2 further comprising the step of bending said transition so as to align the gauge lines of said portion and of the balance of the length of rail stock which has not been machined.

* * * * *